US008597405B2

(12) United States Patent
Ma

(10) Patent No.: US 8,597,405 B2
(45) Date of Patent: Dec. 3, 2013

(54) SELF-CLEANING ELECTRET FILTER

(75) Inventor: Yuchen Ma, Shanghai (CN)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/574,158

(22) PCT Filed: Aug. 23, 2011

(86) PCT No.: PCT/CN2011/078747
§ 371 (c)(1),
(2), (4) Date: Jul. 19, 2012

(87) PCT Pub. No.: WO2013/026193
PCT Pub. Date: Feb. 28, 2013

(65) Prior Publication Data
US 2013/0047846 A1 Feb. 28, 2013

(51) Int. Cl.
*B03C 3/28* (2006.01)
*B03C 3/74* (2006.01)

(52) U.S. Cl.
USPC ..... 95/57; 55/DIG. 39; 95/74; 96/30; 96/69

(58) Field of Classification Search
USPC ..... 95/57, 74; 96/15, 30, 31, 54, 69, 88, 98, 96/99; 55/282, 282.1, 301, 527, 528, 55/DIG. 5, DIG. 39
See application file for complete search history.

(56) References Cited

U.S. PATENT DOCUMENTS

| | | | | | |
|---|---|---|---|---|---|
| 2,490,979 | A | * | 12/1949 | Palmer | 96/31 |
| 3,449,093 | A | * | 6/1969 | Baxt et al. | 307/400 |
| 4,185,972 | A | | 1/1980 | Nitta et al. | |
| 4,257,258 | A | | 3/1981 | Bovenlander | |
| 4,308,223 | A | | 12/1981 | Stern | |
| 4,564,721 | A | | 1/1986 | Ishikawa et al. | |
| 4,874,399 | A | * | 10/1989 | Reed et al. | 95/57 |

(Continued)

FOREIGN PATENT DOCUMENTS

| | | |
|---|---|---|
| CN | 1869648 | 11/2006 |
| CN | 101526460 | 9/2009 |

(Continued)

OTHER PUBLICATIONS

International Search Report for PCT/CN2001/078747 Dated May 31, 2012.

(Continued)

*Primary Examiner* — Richard L Chiesa
(74) *Attorney, Agent, or Firm* — Foley & Lardner LLP; James F. Ewing; James M. White

(57) ABSTRACT

An illustrative filter includes an electret material, which has a long-lasting electric charge, that is at least partially coated or covered with a conductive layer. An optional insulation layer may be disposed over at least part of the conductive layer. If the electret material has a positive charge, then the filter attracts particles with a negative charge, and vice versa. The filter adsorbs the attracted particles until it becomes saturated with particles, at which point the conductive layer is charged to have a polarity that is opposite the built-in polarity of the electret and that matches the polarity of the adsorbed particles. The charged conduction layer repels the adsorbed particles from the filter, cleaning the filter for continued use.

25 Claims, 2 Drawing Sheets

(56) References Cited

U.S. PATENT DOCUMENTS

| | | | | |
|---|---|---|---|---|
| 5,474,600 | A * | 12/1995 | Volodina et al. | 96/57 |
| 5,549,735 | A | 8/1996 | Coppom | |
| 5,578,113 | A | 11/1996 | Glenn | |
| 5,639,287 | A * | 6/1997 | Van de Graaf et al. | 55/385.3 |
| 5,766,318 | A * | 6/1998 | Loreth et al. | 96/69 |
| 6,225,623 | B1 | 5/2001 | Turner et al. | |
| 6,527,834 | B1 * | 3/2003 | Jorder et al. | 96/68 |
| 6,573,205 | B1 * | 6/2003 | Myers et al. | 442/414 |
| 6,616,736 | B2 | 9/2003 | Massey et al. | |
| 6,749,669 | B1 * | 6/2004 | Griffiths et al. | 96/67 |
| 6,888,140 | B2 | 5/2005 | Hayn | |
| 7,041,925 | B2 | 5/2006 | Gates | |
| 7,101,422 | B1 * | 9/2006 | Altman et al. | 96/30 |
| 7,294,169 | B2 * | 11/2007 | Taylor | 95/2 |
| 7,680,243 | B2 | 3/2010 | Yokhin et al. | |
| 7,728,253 | B2 | 6/2010 | Hopwood | |
| 2006/0180023 | A1 * | 8/2006 | Coppom et al. | 95/59 |
| 2007/0028767 | A1 * | 2/2007 | Choi et al. | 95/59 |

FOREIGN PATENT DOCUMENTS

| | | | | |
|---|---|---|---|---|
| CN | 101887003 | | 11/2010 | |
| EP | 0 620 044 | | 1/1900 | |
| EP | 620044 | A2 * | 10/1994 | 55/DIG. 39 |
| GB | 2 308 320 | | 6/1997 | |
| GB | 2308320 | | 6/1997 | |
| JP | 63-178864 | | 7/1988 | |
| JP | 01-258714 | | 10/1989 | |
| JP | 06-218211 | | 8/1994 | |

OTHER PUBLICATIONS

Baumgartner, H and Loffler, F., "Particle Collection in Electret Fibrous Filters: a Basic Theoretical and Experimental Study," Filtration and separation, vol. 24, No. 5, pp. 346-351 (1987).

International Preliminary Report on Patentability in PCT/CN2011/076488 dated Jan. 8, 2011, pp. 1-7.

International Search Report and Written Opinion for PCT/CN2011/076488 dated Oct. 20, 2011.

International Search Report for PCT/CN2011/078747 Dated May 31, 2012.

J. Van Turnhout, J.W.C. Adamse and W.J. Hoeneveld, "Electret filters for high-efficiency air cleaning," Journal of Electrostatics vol. 8, Issue 4, Apr. 1980, pp. 369-379.

Lee, H.M. et al., "Bipolar diffusion charging for aerosol nanoparticle measurement using a soft X-ray charger" Journal of Aerosol Science, vol. 36, Issue 7, pp. 813-829, Jul. 2005.

Pecora, R., "Dynamic Light Scattering Measurement of Nanometer Particles in Liquids," Journal of Nanoparticle Research, vol. 2, Issue 2, pp. 123-131, Jun. 2000.

* cited by examiner

SELF-CLEANING ELECTRET FILTER

RELATED APPLICATIONS

This application is a national phase application under 35 U.S.C. §371 of PCT/CN2011/078747, filed on Aug. 23, 2011, which application is hereby incorporated herein by reference in its entirety.

BACKGROUND

An electret is a dielectric material with an embedded static electric charge and/or a dipole polarization. Electrets have high resistance, so their static electric charges and/or dipole orientations are quasi-permanent, i.e., their static electric charges and/or dipole orientations remain intact for time periods of up to hundreds of years. Because electrets have a static charge, they attract oppositely charged particles. This property can be exploited to remove oppositely charge particles that flow over or through a fibrous structure or thin film of electret material. The oppositely charged particles cling to the electret material until the filter becomes overloaded with particles, at which point the filter is cleaned manually or discarded and replaced.

SUMMARY

Embodiments of the present technology include a filter with at least one electret material having an electric charge to attract particles having an opposite electric charge and at least one conductive material disposed over at least part of the electret material. The conductive material may be configured to prevent particles attracted to the electret material from contacting the electret material. In some illustrative examples, the electret material may include polytetrafluoroethylene (PTFE), fluorinated ethylene propylene (FEP), or both PTFE and FEP. The electret material may be about 100 μm thick to about 5.0 mm thick. The conductive material may include metal, conductive plastic, conductive rubber, conductive carbon (e.g., active carbon), or any combination thereof and may be about 10 μm thick to about 1000 μm thick.

Illustrative filters may also include at least one insulating material disposed over at least part of a surface of the conductive material to prevent the particles attracted to the electret material from contacting the conductive material. The insulating material may include insulating rubber and can have a thickness of about 1 μm to about 100 μm.

An illustrative filter may be used in combination with a switch that controls a charge generator, which is in electrical communication with the conductive material. Actuating the switch causes the charge generator, which may include a Van der Graaf generator, to charge the conductive material so as to repel the particles attracted to the electret material. For example, the switch can be configured to charge the conductive material with a charge whose magnitude is greater than the electric charge of the electret material. In addition, the switch can be further configured to vary the duration and intensity of the charge applied by the charge generator to the conductive material.

Another embodiment of the present technology is a filter that includes a weave of threads, each of which includes an insulating material disposed about a conductive material, which, in turn, is disposed about an electret material with an electric charge to attract particles that have an opposite electric charge. Each thread in the weave can have an outer diameter of about 100 μm to about 1000 μm. Adjacent threads may be spaced apart by about 500 μm to about 5000 μm.

Still another embodiment of the technology disclosed herein includes a method of cleaning a filter with a conductive material disposed over at least part of an electret material, which has a first electric charge to attract particles having an opposite electric charge. The conductive material is charged with a second electric charge having an polarity opposite that of the first electric charge so as to repel the particles attracted to the electret material. In some cases, the method further includes preventing the particles attracted to the electret material from contacting the electret material with an insulating material disposed over at least part of a surface of the conductive material.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The accompanying drawings, which are incorporated in and constitute a part of this specification, illustrate embodiments of the disclosed technology and together with the description serve to explain principles of the disclosed technology.

DETAILED DESCRIPTION

Once charged, conventional electrets (and electret filters) retain their charge for a very long time, e.g., decades or hundreds of years. The electret/conductive composite materials disclosed herein allow electrets to quickly change and recover their electric properties, which provides a broader foundation for application of the electret material. Compared with conventional electret materials, an illustrative composite material is more controllable because it allows for the temporary (or permanent) masking or polarity reversal of the electret's quasi-permanent electric charge. This property can be used to attract and/or repel charged particles from the surface of the composite material, and may be useful in just about any application involving electret materials.

Figure 1:
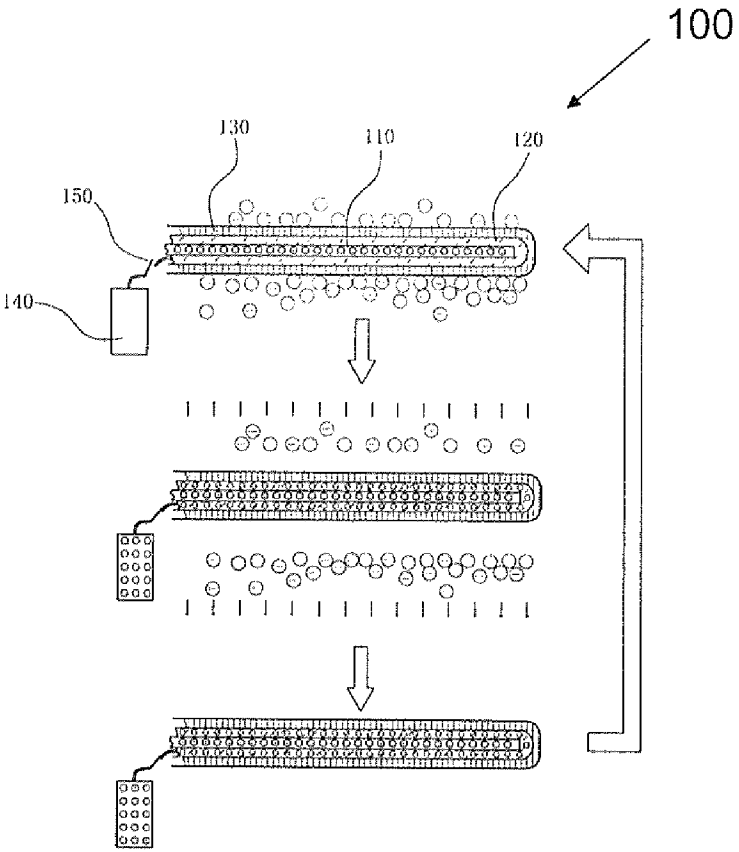
FIG. 1 illustrates how to clean an exemplary electret filter.

FIG. 1 shows a cross section of an illustrative filter 100 made of electret/conductive composite material. The filter's inner core includes an electret material 110 with a quasi-permanent positive electric charge that can last for a long period of time, e.g., up to hundreds of years. As understood by those of skill in the art, the magnitude of the quasi-permanent electric charge depends on the charging method and the structure of the electret material. For example, the electret material 110 may be charged to a potential of about 30-3000 V, e.g., 30 V, 50 V, 100 V, 250 V, 500 V, 1000 V, 1500 V, 2000 V, 2500 V, 3000 V, or any potential between any two of these values. The electret material 110 may be made from a synthetic polymer, such a fluoropolymer (e.g., PTFE), polypropylene (e.g., FEP), polyethyleneterephthalate, or combinations thereof, using techniques understood by those of skill in the art. The electret material 110 can be about 10 μm thick to about 5.0 mm thick. In some examples, the electret material 110 has a thickness of about 10 μm, 50 μm, 100 μm, 200 μm, 300 μm, 500 μm, 750 μm, 1.0 mm, 2.5 mm, 5.0 mm, or ranges between any two of these values.

The electret material 110 can be fully or partially covered by a layer of conductive material 120, such as metal, conductive plastic, conductive rubber, and/or conductive carbon (e.g., activated carbon). The conductive material 120 can be pasted or folded on the electret material 110. It can also be coated on the electret material 110 by a galvanization or vapor deposition process as understood in the art. Illustrative conductive rubber may made by incorporating particles of conductive carbon black, silver, and/or other conductive material into silicone rubber. The conductive material 120 has a thickness of about 10 μm to about 1000 μm, e.g., about 10 μm, 25 μm, 50 μm, 100 μam, 250 μm, 500 μm, 1000 μm, or ranges between any two of these values. In the filter 100 shown in FIG. 1, the conductive material 120 covers both sides and one edge of the electret material 110. In other examples, the conductive material 120 may cover only a portion of the electret material 110, e.g., the portion of the electret material 110 exposed to oppositely charged particles. The conductive material 120 can be electrically coupled via at least one switch 150 to at least one charge generator 140, such as a Van der Graaf generator or other suitable charge generator.

The filter 100 optionally further includes at least one layer of insulating material 130 that partially or fully covers the conductive material 120. The insulating material 130 can include hybrid insulation materials and/or organic insulation materials, such as shellac, resin, and insulating rubber. The layer of insulating material 130 may be formed by coating the conductive material 120 with a liquid, then allowing the liquid to dry. In other cases, the layer of insulating material can be formed by vapor deposition or any other suitable deposition process. The insulating material 130 can have a thickness of about 1 μm to about 100 μm, e.g., about 1 μm, 5 μm, 10 μm, 25 μm, 50 μm, 100 μm, or ranges between any two of these values. In the filter 100 shown in FIG. 1, the insulating material 130 covers both sides and one edge of the conductive material 120. In other examples, the insulating material 130 may cover only a portion of the conductive material 120, e.g., the portion of the electret material 110 exposed to oppositely charged particles.

In some examples, the electret material 110, conductive material 120, and optional insulating material 130 may arranged as part of a film, e.g., in strips, patches, or flat sections. In other examples, the electret material 110, conductive material 120, and optional insulating material 130 are arranged to form strands, threads, or filaments in which the electret material 110 forms the core and the conductive material 120 and optional insulating material 130 form layers disposed concentrically about the core such that the total diameter of each strand, thread, or filament can be about 100 μm to about 1000 μm, e.g., about 100 μm, 250 μm, 500 μm, 750 μm, 1000 μm, or ranges between any two of these values. Such strands, threads, or filaments can be arranged in a weave pattern where adjacent parallel strands, threads, or filaments are separated or spaced apart by about 500 μm to about 5000 μm, e.g., about 500 μm, 750 μm, 1000 μm, 2500 μm, 5000 μm, or ranges between any two of these values, to form apertures through which gas can flow. The apertures may be square, rectangular, triangular, or any other shape as determined by the weave pattern. The apertures can be regular or irregular in shape. The apertures can be identical or different in shape and size.

In operation, particles flow through, across, or over the filter 100. Illustrative filters 100 may trap particles whose diameters range from about 1 nm to about 500 μm, e.g., about 1 nm, 10 nm, 100 nm, 500 nm, 1 μm, 10 μm, 50 μm, 100 μm, 250 μm, or 500 μm. The quasi-permanent charge of electret material 110 attracts oppositely charged particles, which may adhere to the surface of the filter 100. The conductive material 120 (and the optional insulating material 130) prevents adsorbed particles from contacting the electret material 110. Although FIG. 1 shows an electret material 110 with a quasi-permanent positive charge to attract negatively charged particles, those of skill in the art will readily appreciate that the electret material 110 could have a quasi-permanent negative charge to attract positively charged particles.

Eventually, the filter 100 collects enough particles to reduce or prevent continued effective filtration as shown at the top of FIG. 1. Closing the switch 150 connecting the conductive material 120 to the charge generator 140 causes the charge generator 140 to generate negative charge and to charge the conductive material 120 with the generated negative charge as shown in the middle of FIG. 1. The negatively charged conductive material 120 repels the negatively charged particles from the surface of the filter 100, leaving the filter surface at least substantially free of particles as shown at the bottom of FIG. 1. Alternatively, a charge generator may generate a positive charge to repel positively charged particles from an electret material with a quasi-permanent negative charge. In either case, the charge generated by the charge generator may have a magnitude that is more than twice the magnitude of the electret material's quasi-permanent charge, e.g., equivalent to a potential of about 60-6000 V. For example, the potential may be about 60 V, 100 V, 200 V, 500 V, 500 V, 2000 V, 3000 V, 4000 V, 5000 V, 6000 V, or any potential between any two of these values. The repelled particles can be blown or sucked away from the filter 100 or collected with an electrostatic trap. Opening the switch 150 disconnects the charge generator 140 from the conductive material 120. The conductive material 120 may then revert to an uncharged (neutral) state, e.g., through charge reversal.

The switch 150 may also control the frequency, intensity, and/or duration of the charge cleaning process illustrated in FIG. 1. For example, the switch 150 may be coupled to a detector (not shown) that senses when the filter 100 becomes too dirty to function effectively (i.e., covered in particles). Alternatively, or in addition, the switch 150 may be coupled to a clock (not shown) that triggers the cleaning process at regularly scheduled or periodic intervals. The switch 150 may also control how much charge is generated and/or how much charge is applied to the conductive material 120. In some instances, the switch 150 may be set to charge the conductive material 120 by an amount whose magnitude exceeds the magnitude of the electret material's quasi-permanent charge to promote the repulsion of particles from the filter. The switch 150 may also control the charging rate and/or charging duration.

Figure 2B:
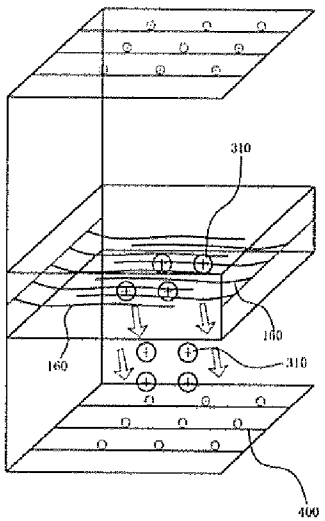
FIGS. 2A and 2B illustrate the operation of an alternative electret filter.
Figure 2A:
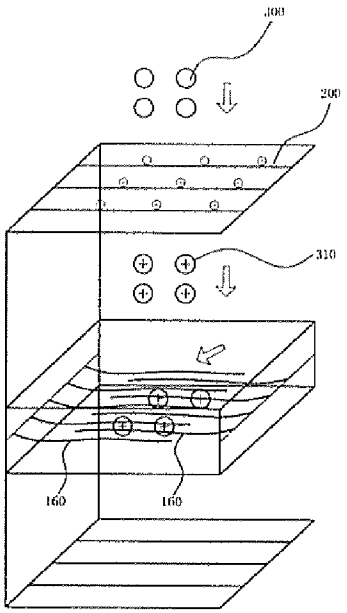

FIGS. 2A and 2B illustrate the operation of another illustrative filter that employs a filter carrier 160 with strands of a composite material that includes electret material with a quasi-permanent negative charge at least partially or fully coated with conductive material. The filter carrier 160 serves as a working medium for achieving filter functions and can be a fibrous, granular, mesh, or sheet material. A positively charged grid 200 positioned above the filter carrier 160 imparts a positive charge to neutral particles 300 flowing towards the filter carrier 160. The composite material in the filter carrier 160 attracts positively charged particles 310, which cling to the strands of composite material in the filter carrier 160 as shown in FIG. 2A. Applying a positive charge to the conductive portion of the composite material repels the positively charged particles 310 from the filter carrier 160 as shown in FIG. 2B. An optional negatively charged grid 400 positioned beneath the filter carrier 160 attracts the positively charged particles 310, which can be collected on the negatively charged grid 400 or otherwise removed from the filter carrier 160. Those skilled in the art will readily appreciate that positive and negative charges may be substituted for, respectively, the negative and positive charges of FIGS. 2A and 2B.

Composite electret/conductive material can also be used to disperse particles into an atmosphere instead of to filter or remove particles from an atmosphere. For example, charged particles can be loaded onto conductive material disposed over an electret material with a quasi-permanent opposite charge, e.g., using a charging grid such as the one shown in FIGS. 2A and 2B. The quasi-permanent charge of the electret material holds the particles in place until the particles are ready to be dispersed or discharged into the atmosphere, at which point a repulsive charge is applied to the conductive material. Alternatively, the particles can be held in place by a transient charge on the conductive material and repelled by the quasi-permanent charge of the electret material if/when the transient charge dissipates or diminishes in strength.

Composite electret/conductive material can also be used in or as fabric, e.g., for uniforms or hunting gear, to odorize and/or deodorize dirty garments. For example, charging the conductive layer of the dirty garment makes it possible to apply an oppositely charged deodorizing agent that can later be repelled by the permanent charge of the electret material. Alternatively, a transient charge on the conductive layer can be used to hold a certain substance (e.g., a pheromone to attract game) until the wearer is ready to release the substance by discharging the conductive layer (e.g., when the game comes within rifle range).

Composite electret/conductive materials, including composite fabrics, can also be used to selectively and/or controllably sense airborne chemical and/or biological substances. In some instances, the fabric is treated or coated with a substance that changes color, temperature, stiffness, and/or smell when exposed to a specific chemical and/or biological substance, such as a pathogen. The change alerts the wearer to the presence of the substance. The fabric can be cleaned as described above for later use. Different areas of the fabric may also be treated with different substances to detect different types of biological and/or chemical agents. Such composite material or fabric can also be for other filtration applications, including drug screening, biological and chemical weapons sensing, water testing, etc.

EXAMPLE 1

Composite Filter

A composite filter can be made by coating polytetrafluoroethylene (PTFE) with a layer of conductive rubber. First, the PTFE is stretched to a thickness of about 1.0 mm and a size of about 100 cm by 100 cm; it is then heated above its melting temperature (327° C.) while supported by a frame. The PTFE sheet cools for about 3-100 minutes in the presence of a strong electric field (supplied, e.g., by a voltage of about 300 V to about 10 kV applied across the sheet), which causes charge carriers (dipoles) in the cooling PTFE to align in themselves in one direction. This alignment gives the PTFE a quasi-permanent dipole moment whose potential is about 100 V. Once the PTFE sheet is fully cooled, the electric field is turned off, and a 100 μm thick layer of conductive rubber is coated onto both sides of the PTFE sheet. The PTFE sheet is then cut into rectangular pieces of about 1 cm by about 1 cm, and each piece is attached to a metal or conductive ceramic frame to form a filter.

EXAMPLE 2

Composite Filter with Insulating Layer

A composite filter can be made by coating fluorinated ethylene propylene (FEP) with a thin layer of metal and a thick layer of insulating rubber. First, the FEP heated above its melting temperature (260° C.) while supported on a roller and stretched or extruded to a thickness of about 500 μm. Electrodes on one of the roller apply a strong electric field (e.g., about 300 V to 10 kV applied to the roller for about 3-100 minutes) to the cooling sheet of FEP, which causes charge carriers (dipoles) in the cooling FEP to align in themselves in one direction. This alignment gives the FEP a quasi-permanent dipole moment with a potential of about 1000 V. Once the FEP sheet is fully cooled, the electric field is turned off, and a 100 μm thick layer of metal is sputtered onto one side of the FEP sheet. The metal layer is then coated with a 1.0 mm thick layer of insulating rubber. The resulting composite material is cut into square pieces, and each piece is attached to a conductive plastic frame to form a filter.

EXAMPLE 3

Thick Composite Filter

A thick composite filter can also be made by wrapping one or more sheets of PTFE onto a mandrel or cylinder in a cigarette- or cigar-style wrap. The resulting PTFE tube, which may be about 1.0 mm thick and have a diameter of about 25 mm, is sealed by heating the PTFE above 327° C. while the PTFE is still on the mandrel or cylinder. Electrodes apply an strong electric field to the PTFE as it cools, causing the PTFE to become an electret with a built-in potential of about 50 V. The PTFE is sprayed with liquid plastic to form a 500 μm thick layer of conductive plastic, then cut off the mandrel or cylinder and cut into circles. Each circle is attached to a frame to form a filter.

EXAMPLE 4

Extruded Composite Filter with Insulating Layer

An extruded composite filter can be made by heating a PTFE tube to its melting point and extruding the hot PTFE through a press to form a hollow shape, such as a cylinder, polygonal tube, or oval tube, with a thickness of about 250 μm. The extruded PTFE cools in the presence of a strong electric field, which causes charge carriers (dipoles) in the cooling PTFE to align in themselves in one direction, giving the PTFE a quasi-permanent dipole moment with a potential of about −1500 V. Once the PTFE shape is fully cooled, the electric field is turned off, and the PTFE shape is placed in an injection mold. The injection mold is filled first with conductive rubber, then silicone, to form 50 μm thick conductive and insulating layers on the inside and outside of the PTFE sheet to form the filter. A wire is inserted into the mold after the PTFE is coated with conductive rubber and before the PTFE is covered with the insulating layer to create an electrical connection for charging (and discharging) the PTFE. Once the conductive rubber and silicone have cooled, the PTFE shape is removed from the mold and allowed to cure.

EXAMPLE 5

Portable Filter

A portable electret/conductive composite filter for home or office use effectively removes and reduces dust, pollen, and odors. A remote-controlled, adjustable fan sucks particles in the air through a charging grid and towards a composite filter. The charging grid charges the particles to a potential of about 50 V to about 10 kV as the particles propagate towards the composite filter. The quasi-permanent electric charge of the electret in the composite filter attracts the charged particles. A coating on the filter reduces the development of bacteria, odor, and dust mites. Once the composite filter becomes saturated with particles, the conductive material is charged to repel particles adsorbed to the surface of the filter.

EXAMPLE 6

Wearable Respirator

A wearable respirator made of electret/conductive composite material provides respiratory protection from particles created by grinding, sanding, buffing, and/or other activities. The composite material is formed into a moldable facepiece, which is held over a user's mouth and nose with an adjustable noseclip and new braided headstraps. The quasi-permanent charge, which gives the electret a potential of about 2 kV, of the electret filters charged particles from the air sucked through the mask by the user's breathing. Once the mask becomes clogged, the user touches an edge or patch of the conductive material to a charge source that produces a charge whose polarity is opposite the polarity of the quasi-permanent electret charge. The conductive material becomes charged to a potential of about −4 kV, repelling the particles adsorbed to the respirator. The clean respirator can be used and cleaned repeatedly.

EXAMPLE 5

Portable Filter

An electret/conductive composite filter effectively removes and reduces charged particles escaping from a sputtering hood via a duct. Negative pressure sucks the particles from the hood into the duct. As particles travel through the hood, they stick to the filter, which is stretched across the hood. A detector downstream from the filter measures the air quality of the travelling through the duct. If the detector senses that the air quality is too poor (e.g., based on the amount of dust in the air), it activates a charge generator, which cleans the filter by applying an electric field (e.g., with a potential source of about 100 V to about 20 kV) to the filter's conductive layer.

The subject matter described herein sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations.

However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.).

It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the embodiments be defined by the claims appended hereto and their equivalents.

What is claimed is:

1. A filter comprising:

at least one electret material having an electric charge to attract particles having an opposite electric charge;

at least one conductive material disposed over at least part of the electret material to prevent particles attracted to the electret material from contacting the electret material; and at least one insulating material disposed over at least part of a surface of the conductive material to prevent the particles attracted to the electret material from contacting the conductive material.

2. The filter of claim 1 wherein the insulating material includes insulating rubber.

3. The filter of claim 1 wherein the insulating material has a thickness of about 1 μm to about 100 μm.

4. The filter of claim 1 further comprising:

a charge generator in electrical communication with the conductive material; and a switch configured to cause the charge generator to charge the conductive material so as to repel the particles attracted to the electret material.

5. The filter of claim 4 wherein the charge generator includes a Van der Graaf generator.

6. The filter of claim 4 wherein the switch is further configured to vary a duration and intensity of charge applied by the charge generator to the conductive material.

7. The filter of claim 4 wherein the switch is further configured to charge the conductive material with a charge whose magnitude is greater than the electric charge of the electret material.

8. A filter comprising:

a weave of threads, each thread comprising:

an electret material having an electric charge to attract particles having an opposite electric charge;

a conductive material disposed about the electret material; and an insulating material disposed about the conductive material.

9. The filter of claim 8 wherein each thread in the weave has an outer diameter of about 100 μm to about 1000 μm and wherein adjacent threads are spaced apart by about 500 μm to about 5000 μm.

10. The filter of claim 8 wherein the electret material comprises at least one of polytetrafluoroethylene and fluorinated ethylene propylene.

11. The filter of claim 8 wherein the conductive material comprises at least one of metal, conductive plastic, and conductive rubber.

12. The filter of claim 8 wherein the insulating material includes insulating rubber.

13. The filter of claim 8 further comprising:

a charge generator in electrical communication with the conductive material; and a switch configured to cause the charge generator to charge the conductive material so as to repel the particles attracted to the electret material.

14. The filter of claim 13 wherein the charge generator includes a Van der Graaf generator.

15. The filter of claim 13 wherein the switch is further configured to vary a duration and intensity of charge applied by the charge generator to the conductive material.

16. A method of cleaning a filter, the method comprising:

providing an electret material having a first electric charge to attract particles having an opposite electric charge and a conductive material disposed over at least part of the electret material; and charging the conductive material with a second electric charge having a polarity opposite that of the first electric charge so as to repel the particles attracted to the electret material.

17. The method of claim 16 wherein the electret material comprises at least one of polytetrafluoroethylene and fluorinated ethylene propylene.

18. The method of claim 16 wherein the electret material has a thickness of about 100 μm to about 1.0 mm.

19. The method of claim 16 wherein the conductive material has a thickness of about 10 μm to about 1000 μm.

20. The method of claim 16 further comprising preventing the particles attracted to the electret material from contacting the electret material with an insulating material disposed over at least part of a surface of the conductive material.

21. The method of claim 20 wherein the insulating material includes insulating rubber.

22. The method of claim 20 wherein the insulating material has a thickness of about 1 μm to about 100 μm.

23. The method of claim 16 wherein charging the conductive material comprises:

actuating a switch to cause a charge generator to generate charge; and applying the charge to the conductive material.

24. The method of claim 23 wherein the charge generator includes a Van der Graaf generator.

25. The method of claim 16 wherein charging the conductive material includes varying a duration, intensity, or both duration and intensity, of charge applied to the conductive material.

* * * * *

UNITED STATES PATENT AND TRADEMARK OFFICE

CERTIFICATE OF CORRECTION

PATENT NO. : 8,597,405 B2
APPLICATION NO. : 13/574158
DATED : December 3, 2013
INVENTOR(S) : Ma It is certified that error appears in the above-identified patent and that said Letters Patent is hereby corrected as shown below:

On the Title Page, in Item (56), under "OTHER PUBLICATIONS", in Column 2, Lines 1-2, delete "International Search Report for PCT/CN2001/078747 Dated May 31, 2012.".

On Title Page 2, in Item (56), under "FOREIGN PATENT DOCUMENTS", in Column 1, Line 2, delete "EP 0 620 044 1/1900".

In the Specification:

In Column 1, Line 3, delete "APPLICATIONS" and insert -- APPLICATION --, therefor.

In Column 2, Line 6, delete "an polarity" and insert -- a polarity --, therefor.

In Column 3, Line 10, delete "100 μam," and insert -- 100 μm, --, therefor.

In Column 6, Line 27, delete "an strong" and insert -- a strong --, therefor.

Signed and Sealed this
Fifteenth Day of April, 2014

Michelle K. Lee

Michelle K. Lee
*Deputy Director of the United States Patent and Trademark Office*